United States Patent [19]

Pieper

[11] 4,260,240

[45] Apr. 7, 1981

[54] MOVABLE SUPPORT FOR ELECTROSTATIC CORONA DISCHARGE DEVICE

[75] Inventor: Reinhold Pieper, Wilhelmshaven, Fed. Rep. of Germany

[73] Assignee: Olympia Werke AG, Wilhelmshaven, Fed. Rep. of Germany

[21] Appl. No.: 91,499

[22] Filed: Nov. 5, 1979

[30] Foreign Application Priority Data

Nov. 13, 1978 [DE] Fed. Rep. of Germany ..... 2849233

[51] Int. Cl.[3] ..... G03G 15/00

[52] U.S. Cl. ..... 355/3 CH; 250/325; 355/3 TR

[58] Field of Search ..... 355/3 CH, 3 TR; 250/324–326; 361/225

[56] References Cited

U.S. PATENT DOCUMENTS

| | | | |
|---|---|---|---|
| 3,800,153 | 3/1974 | Matsumoto et al. | 250/325 |
| 3,811,048 | 5/1974 | Matsumoto et al. | 250/325 |
| 3,872,307 | 3/1975 | Miyamoto | 250/325 |
| 3,912,989 | 10/1975 | Watanabe et al. | 250/325 |
| 3,937,960 | 2/1976 | Matsumoto et al. | 250/326 |

FOREIGN PATENT DOCUMENTS

| | | | |
|---|---|---|---|
| 2321836 | 11/1974 | Fed. Rep. of Germany | 250/325 |
| 2649676 | 3/1978 | Fed. Rep. of Germany | 250/325 |

*Primary Examiner*—R. L. Moses

*Attorney, Agent, or Firm*—Spencer & Kaye

[57] ABSTRACT

In an electrostatic copier including a device for the electrostatic transfer of a toner image disposed on an electrophotographic recording material to an image receiving material whose rear side is chargeable by a corona discharge device composed of an elongate electrically conductive shielding housing and at least one corona discharge wire clamped in an insulated manner between the housing ends, there are provided: a carrier to which the corona discharge device is fixed; a slide member supporting the carrier and with respect to which the carrier is movable between two end positions for setting the distance between the corona discharge device and the surface of the recording material; a control member connected for moving the carrier between its end positions; guide rails extending parallel to the recording material surface and fixed to the copier; and guide elements fixed to the slide member and arranged to travel along the rails to guide the movement of the slide member, the guide elements being removable from the rails.

6 Claims, 3 Drawing Figures

FIG.1
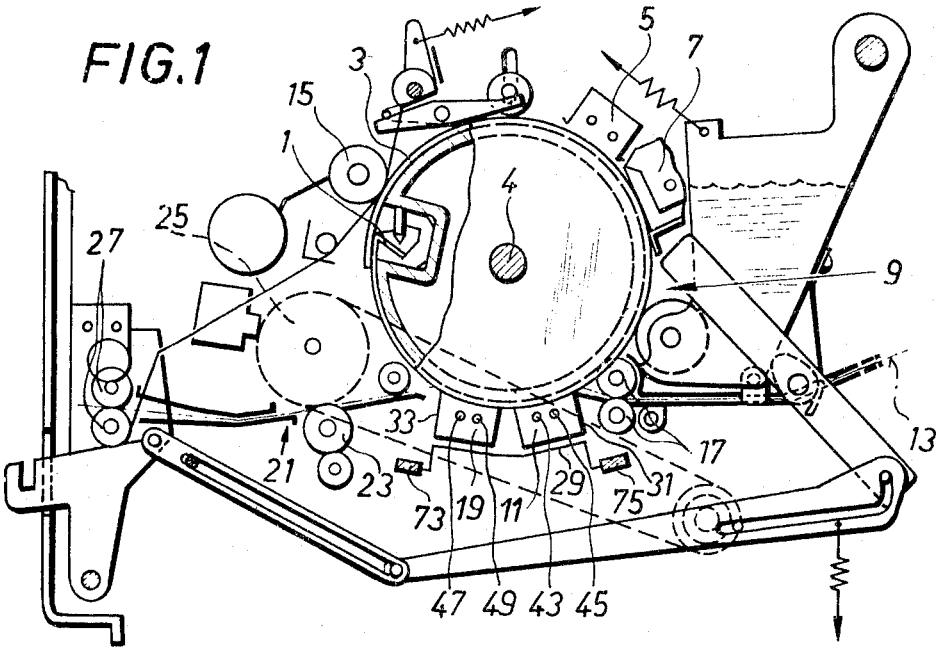
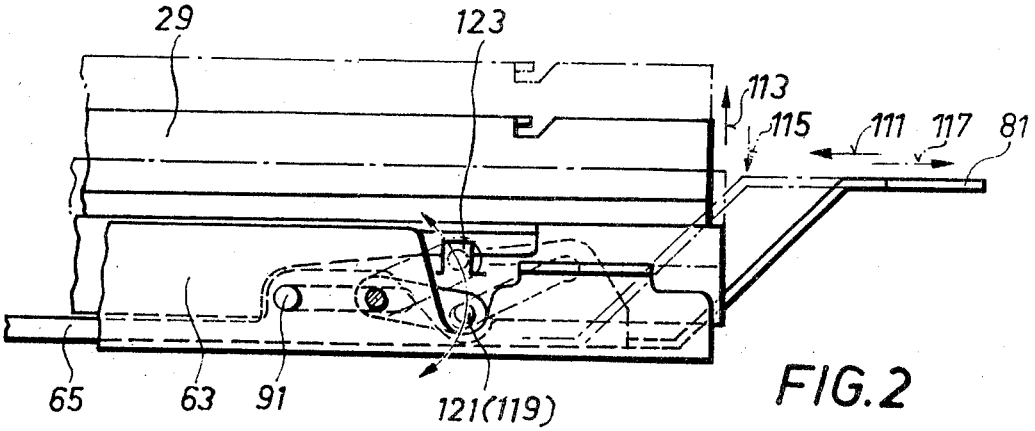
FIG.2

MOVABLE SUPPORT FOR ELECTROSTATIC CORONA DISCHARGE DEVICE

BACKGROUND OF THE INVENTION

The present invention relates to an electrophotographic copier of the type including a device for the electrostatic transfer of a toner image disposed on an electrophotographic recording material to an image receiving material whose rear side is chargeable by a corona discharge device, the latter device being composed of an elongate electrically conductive shielding housing having at least one corona discharge wire clamped in an insulating manner between its ends.

German Offenlegungschrift [Laid-open Application] No. 2,649,676 discloses an adjustment device for setting the distance between such a corona discharge device and the surface of the recording material. With this device it is possible, in addition to making a first precise setting of the structurally prescribed initial distance between the various parts of the recording material surface and the corona discharge device, to also make adjustments when the machine is installed in the field in order to adapt it to changing operating conditions, such as voltage, and environmental conditions such as the ambient temperature and humidity, and fluctuations in quality of the expendable materials employed. But this known device does not permit elimination of a possible paper jam between the electrophotographic recording material and the corona discharge device. Moreover, no means are provided for removing the corona discharge device from the machine in order to clean the corona discharge device or to replace the corona wires.

German Offenlugungsschrift No. 2,321,836discloses a further electrostatic copier which includes a device for effecting a fine setting of the corona system position in order to charge a photoreceptor. The corona system can here be set so that it is capable of compensating for variations in the state of the toner, of the photoreceptor, the corona wire or the original document being copied. But this prior art device also does not include any means with which a paper jam between photoreceptor and corona discharge device can be eliminated quickly.

SUMMARY OF THE INVENTION

It is an object of the present invention to enable the corona discharge device of such a copier to be removed from the copier quickly and safely in order to eliminate a possible accumulation of the image receiving material in the narrow space between the corona discharge device and the electrophotographic recording material, to clean the corona device or to replace the corona wires.

These and other objects are achieved, according to the invention in an electrostatic copier including a device for the electrostatic transfer of a toner image disposed on an electrophotographic recording material to an image receiving material whose rear side is chargeable by a corona discharge device composed of an elongate electrically conductive shielding housing and at least one corona discharge wire clamped in an unsulated manner between the housing ends, by the provision of a support system for the corona discharge device which includes: a carrier to which the corona discharge device is fixed, a slide member supporting the carrier and with respect to which the carrier is movable between two end positions for setting the distance between the corona discharge device and the surface of the recording material, a control member connected for moving the carrier between its end positions, means defining guide rails extending parallel to the recording material surface and fixed to the copier, and means defining guide elements fixed to the slide member and arranged to travel along the rails to guide the movement of the slide member, the guide elements being removable from the rails.

A particular advantage of the present invention is that when the corona discharge device is pulled out of the machine, the electrophotographic recording material cannot be damaged. During this removal process, the space between the electrophotographic recording material and the corona discharge device is first enlarged before the corona discharge device can be displaced parallel to the recording material surface.

According to preferred embodiments of the invention, movement of the carrier between its end position is effected by displacement of the control member relative to the slide member. For this purpose, the control member is provided with a handle via which it can be manually displaced, a first set of elongate holes extending parallel to the guide rails, and a second set of elongate holes oriented at an angle to the guide rails, the slide member is provided with means engaging the first set of holes for permitting movement of the control member parallel to the guide rails, and the carrier is provided with shaft members extending through the second set of holes and movable relative to the second set of holes for causing movement of the carrier between its end positions.

BRIEF DESCRIPTION OF THE DRAWINGS

FIG. 1 is a side elevational view of a portion of a copier provided with a preferred embodiment of a device according to the present invention.

FIG. 2 is a side elevational detail view of a preferred embodiment of the device shown in FIG. 1.

BRIEF DESCRIPTION OF THE PREFERRED EMBODIMENTS

Figure 3:
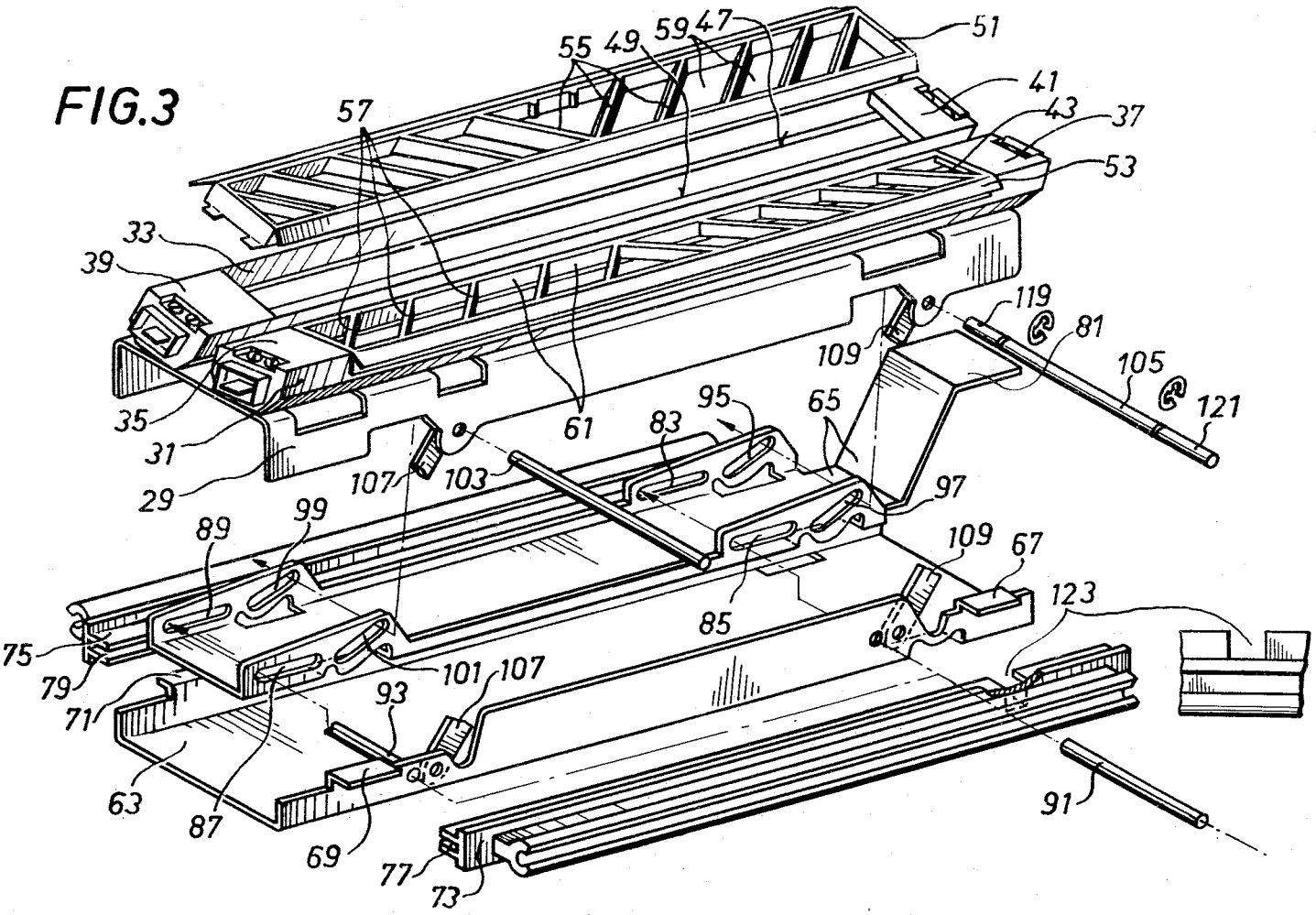
FIG. 3 is a perspective, exploded view of the device shown in FIG. 2.

FIG. 1 is a schematic sectional view of parts of an electrophotographic copier in which electrophotographic recording material in the form of a photoconductive sheet 1 is securely but replaceably connected to a guide drum 3. The guide drum 3 is rotatably mounted, via an axle 4, in a frame of the machine (not shown) so that each point of the drum surface can travel past the individual processing stations. During this procedure, the photoconductive sheet 1 is intially charged in a charging station 5, then photographically exposed in an exposure station 7 and then the image created thereon is developed in the developing station 9. Then the image present on the photoconductive sheet 1 is transferred in a transfer station 11 to an image receiving material 13 in sheet form. The toner particles still remaining on the photoconductive sheet 1 after the transfer are then removed from the photoconductive sheet 1 in a cleaning station 15. The above-mentioned processing stations are shown only schematically and may of course also be designed differently.

The image receiving material 13 comes from a supply roll (not shown) and is guided between pairs of transporting rollers to a cutting device where individual sheets are cut off to a selected length. By means of a further pair of transporting rollers 17 each individual sheet is then brought into contact with the photoconductive sheet 1 on the guide drum 3. The image developed on the photoconductive sheet 1 is then transferred to the image receiving material 13 with the aid of a transfer corona discharge generated at station 11. After this image transfer, the image receiving material 13 is separated from the photoconductive sheet 1 by means of a removal corona discharge in a discharge station 19 and brought to a pressure fixing station 21. This pressure fixing station 21 includes two mutually resilient pressure rollers 23 and 25. After pressure fixing of the toner image on the sheet of image receiving material 13, the latter is discharged via a pair of transporting rollers 27.

The transfer corona station 11, which is designed as corona discharge devices, and the removal corona station 19 are disposed at an angle to one another on a carrier 29 which is arranged alongside the drum 3. Each one of the two corona discharge devices 11 and 19 includes, as shown in FIG. 3, an elongate, electrically conductive shielding housing 31 or 33 of a U-shaped cross section between whose ends 35, 37 or 39, 41 discharge wires 43 and 45 or 47 and 49 are tensioned in an insulated manner.

Each of U-shaped shielding housings 31 and 33 is covered by a perforated conductor plate 53 or 51 of nonconductove material which serves to guide the image receiving material 13. These guide plates 51, 53 are provided, in the forward direction, with diverging ribs 55, 57 and openings 59, 61 the latter being of such design that every point of the image receiving material 13 passing over the guide plates 51 and 53 is aligned with openings, and thus exposed to the corona wires, for the same length of time. The guide plates 51 and 53 are each made of one piece and additionally protect the corona wires 43, 45 and 47, 49 against damage and permit the required rapid replacement of these corona wires.

In order to set the distance between the corona discharge devices and the surface of the recording material 1, the carrier 29 for the corona discharge stations 11 and 19 is mounted on a slide member 63 so that it can be moved, by means of a control member 65, between two end positions. This slide member is provided with guide elements in the form of slide tongues, four of which are provided but only three of which are visible at 67, 69 and 71, via which member 63 can be supported by, and can be pushed into and pulled out of the guide slots 77, 79 of, guides 73 and 75 mounted to extend in the axial direction of the drum 3 and fixed to the machine frame.

As shown in FIG. 3, the control member 65 is a slide provided with a handle 81 and is mounted to be displaceable, on the one hand, on shafts, or axles, 91 and 93 of slide member 63 via horizontal long holes 83, 85 and 87, 88 and, on the other hand, on shafts, or axles 103 and 105 of carrier 29 via inclined long holes 95, 97 and 99, 101. The carrier 29 is connected to slide member 63 in an articulated manner by means of parallel links of which only two 107 and 109, are shown in FIG. 3.

When the slide member 63 with the carrier 29 and the corona devices 11 and 19 is inserted into the copier, the slide is pushed by means of the slide tongue 67, 69, 71 toward the left in the direction of the arrow 111 of FIG. 2 until it reaches an abutment (not shown) in the guides 77 and 79 of the guide rails 73 and 75, respectively. Then the control member 65 is pushed further in the direction of the arrow 111 by means of handle 81 from the solid line position to the dash-dot position of FIG. 2. This lifts the carrier 29 with the corona devices 11 and 19 in the direction of the arrow 113 of FIG. 2 in that axles 103 and 105 are displaced along sloped long holes 95, 97, 99, 101 from the lower end position shown in solid lines to the upper end positon shown in dot-dash lines.

The upper end position is the carrier operating position where only a narrow gap exists between the corona devices 11 and 19 and the surface of the drum 3. Carrier 29 is fixed in the operating position by a blocking device so that in this position the carrier 29 cannot be moved in the direction of the arrow 117 of FIG. 2. This blocking device includes axial protrusions 119 and 121 of the axle 105, which can move into detent recesses 123 in the guide rails 73 and 75 when the carrier 29 is lifted.

If the slide member 63 must be removed from the machine for repair or for cleaning of the corona devices 11 and 19, the slide 65 is pulled in the direction of arrow 117 of FIG. 2 by means of handle 81 so that the carrier 29 with the corona devices 11 and 19 is lowered in the direction of the arrow 115. Only after the extensions 119 and 121 have left the detent recesses 123 in the guide rails 73 and 75, will the slide member 63 also be carried along in the direction of the arrow 117. The inevitable lowering of the carrier 29 during removal from the machine serves to assure that if there is a paper jam in the gap between the corona devices and the surface of the guide drum 3 the recording material on the drum 3 will not be damaged.

It is to be understood that the above description of the present invention is susceptible to various modifications, changes and adaptations, and the same are intended to be comprehended within the meaning and range of equivalents of the appended claims.

What is claimed is:

1. In an electrostatic copier including a device for the electrostatic transfer of a toner image disposed on an electrophotographic recording material to an image receiving material whose rear side is chargeable by a corona discharge device composed of an elongate electrically conductive shielding housing and at least one corona discharge wire clamped in an insulated manner between the housing ends, the improvement comprising: a carrier to which said corona discharge device is fixed; a slide member supporting said carrier and with respect to which said carrier is movable between two end positions for setting the distance between said corona discharge device and the surface of the recording material; a control member connected for moving said carrier between its end positions; means defining guide rails extending parallel to the recording material surface and fixed to the copier; and means defining guide elements fixed to said slide member and arranged to travel along said rails to guide the movement of said slide member, said guide elements being removable from said rails.

2. An arrangement as defined in claim 1 wherein said control member is provided with a handle via which it can be manually displaced, a first set of elongate holes extending parallel to said guide rails, and a second set of elongate holes oriented at an angle to said guide rails, said slide member comprises means engaging said first set of holes for permitting movement of said control member relative to said slide member parallel to said guide rails, and said carrier comprises shaft members extending through said second set of holes and movable relative to said second set of holes causing movement of said carrier between its end positions.

3. An arrangement as defined in claim 2 further comprising parallel pivot links connecting said carrier to said slide member.

4. An arrangement as defined in claim 2 or 3 further comprise blocking means associated with said carrier for preventing movement of said slide member relative to said rails when said carrier is in its end position which is closest to the surface of the recording material.

5. An arrangement as defined in claim 4 wherein said blocking means are constituted by axial projections of said shaft members of said carrier and means defining detent recesses fixed relative to said guide rails and disposed for receining said axial projections when said carrier is in said end position closest to the recording material surface.

6. An arrangement as defined in claim 1 wherein the recording material is mounted on the surface of a rotatable drum, there are two said corona discharge devices mounted on said carrier and spaced apart in the direction of rotation of the drum, said two devices are oriented at an angle to one another, said housing of each said device has a U-shaped cross section, and said at least one wire of each device is tensioned in an insulated manner between ends of its associated housing section.

* * * * *